US006206426B1

(12) United States Patent
Azzato

(10) Patent No.: US 6,206,426 B1
(45) Date of Patent: Mar. 27, 2001

(54) SECURITY HARDWARE DEVICE FOR CLAMPING MULTI-LEAFED MATERIALS

(76) Inventor: Robert N. Azzato, 23429 N. 35th Ave., Pheonix, AZ (US) 85310

( * ) Notice: Subject to any disclaimer, the term of this patent is extended or adjusted under 35 U.S.C. 154(b) by 0 days.

(21) Appl. No.: 09/540,130

(22) Filed: Mar. 31, 2000

(51) Int. Cl.[7] ..... B42F 13/00; B42D 17/00; A47B 97/04

(52) U.S. Cl. ..... 281/45; 281/42; 281/43; 281/48; 281/51; 248/441.1; 248/451; 248/447; 462/71; 462/72; 462/75; 462/76; 462/78; 462/84; 269/43; 269/259; 269/266

(58) Field of Search ..... 281/42, 45, 43, 281/48, 51; 462/71, 72, 75, 76, 78, 84; 248/441.1, 447, 451; 269/43, 266, 259

(56) References Cited

U.S. PATENT DOCUMENTS

| | | | | |
|---|---|---|---|---|
| 468,199 | | 2/1892 | Hunziker . | |
| 806,861 | | 12/1905 | Wolf . | |
| 1,219,777 | * | 3/1917 | Ridall | 281/42 |
| 1,559,971 | | 11/1925 | Meyer . | |
| 1,826,627 | | 10/1931 | Meyerson . | |
| 2,606,042 | | 8/1952 | Freber . | |
| 2,981,259 | | 4/1961 | Smith et al. . | |
| 3,090,347 | | 5/1963 | Harnett, Jr. . | |
| 3,176,952 | * | 4/1965 | Gilmore | 248/447 |
| 3,373,749 | * | 3/1968 | Wance et al. | 248/447 |
| 3,860,212 | | 1/1975 | Nawman . | |
| 3,950,012 | | 4/1976 | Donovan . | |
| 4,285,532 | | 8/1981 | Davis . | |
| 4,306,736 | * | 12/1981 | Cournover et al. | 281/45 |
| 4,352,583 | | 10/1982 | Errichiello . | |
| 4,436,442 | | 3/1984 | Miskin . | |
| 4,561,623 | | 12/1985 | Shepherd et al. . | |
| 4,589,682 | | 5/1986 | Balland . | |
| 4,591,187 | | 5/1986 | Jeanson et al. . | |
| 4,652,013 | * | 3/1987 | Azzato | 281/46 |
| 4,659,109 | | 4/1987 | Donovan . | |
| 5,056,823 | | 10/1991 | Stancato . | |
| 5,096,227 | * | 3/1992 | Pinkerton, Jr. | 248/447 |
| 5,186,496 | | 2/1993 | Seki . | |
| 5,186,497 | * | 2/1993 | Van Pinkerton, Jr. | 281/45 |
| 5,246,251 | | 9/1993 | Evans . | |
| 5,845,941 | | 12/1998 | Fotedar . | |
| 5,979,940 | * | 11/1999 | Araghi | 281/42 |

FOREIGN PATENT DOCUMENTS

| | | |
|---|---|---|
| WO 82/91347 | 4/1982 | (WO) . |

* cited by examiner

*Primary Examiner*—Willmon Fridie, Jr.
*Assistant Examiner*—Mark T. Henderson
(74) *Attorney, Agent, or Firm*—Charles E. Cates; Elizabeth A. Dawn

(57) ABSTRACT

A security hardware device used to hold multi-leafed materials, for example, telephone books, which device has an inner box within an outer sleeve, wherein the inner box has a first end with a toothed grip and a second end with a means for receiving a screw; and the outer sleeve has a first open end for receiving the inner box and second closed end, and wherein the second closed end is provided with a toothed grip and further provided with a hole for passing a screw through the outer sleeve and into the means for receiving a screw so that, as the screw is turned into engagement, the inner box is drawn into the outer sleeve, and a means for attaching the device to a surface.

6 Claims, 3 Drawing Sheets

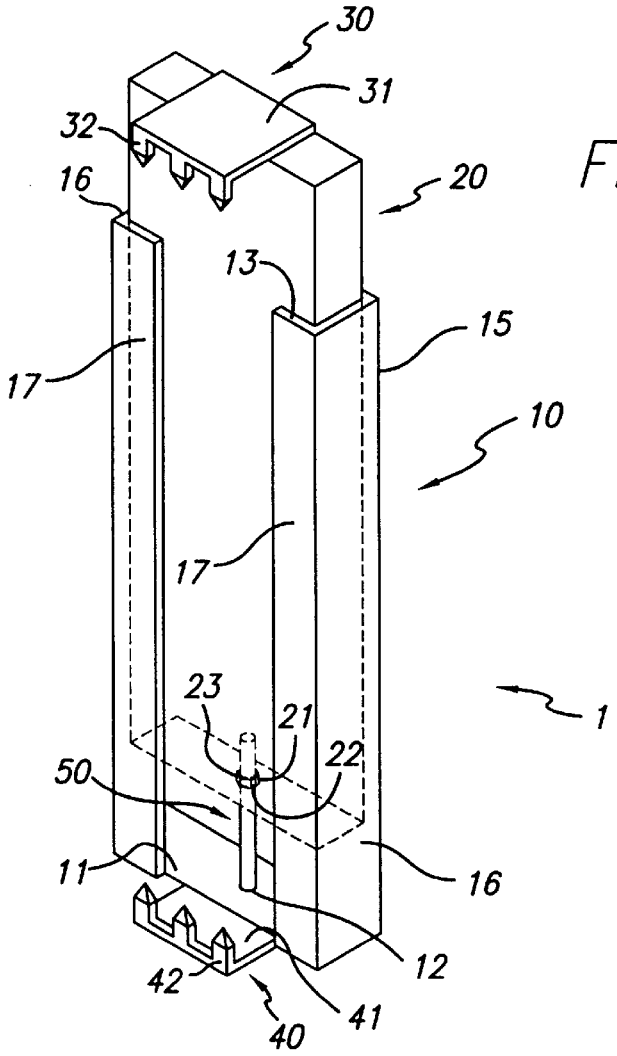
FIG. 1
FIG. 2
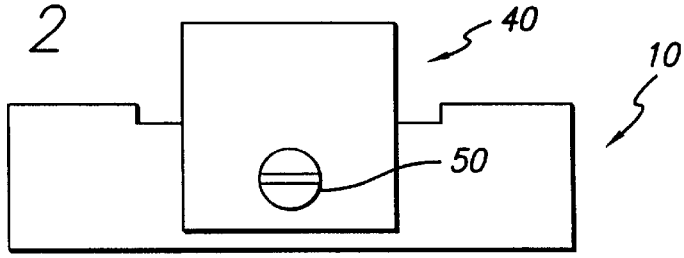
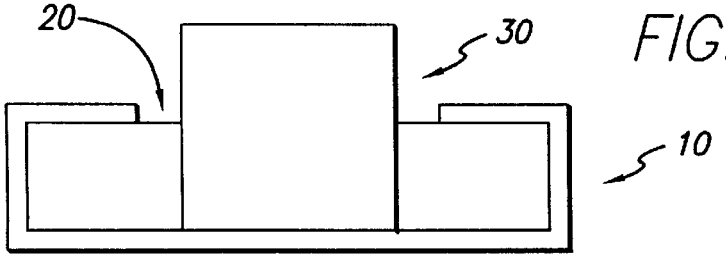
FIG. 3

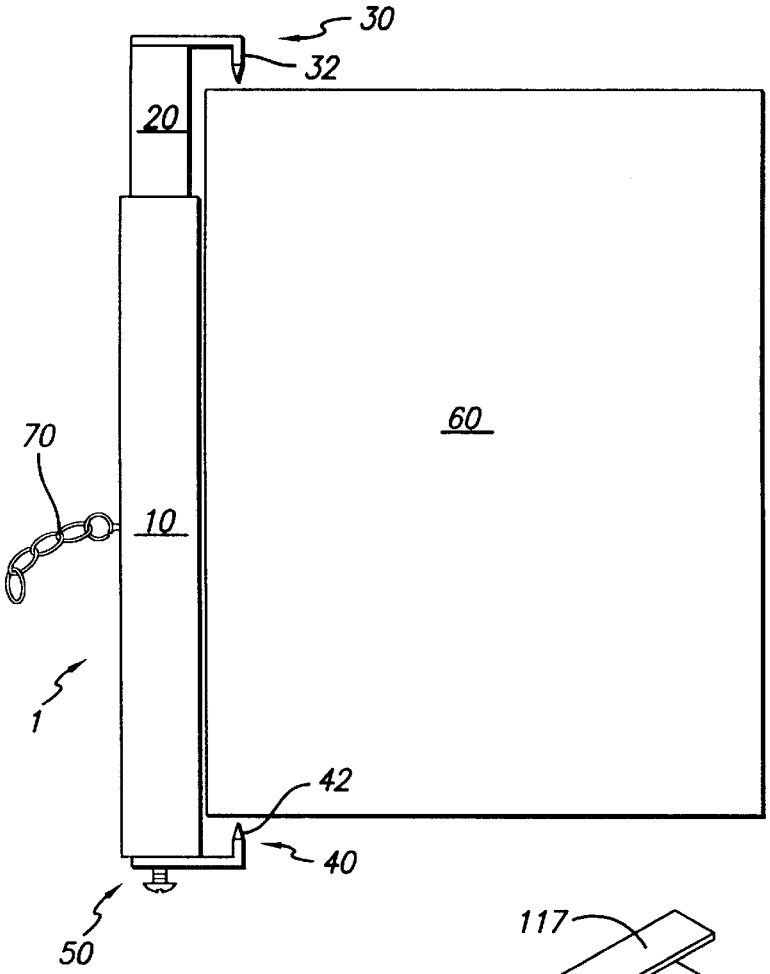
FIG. 4
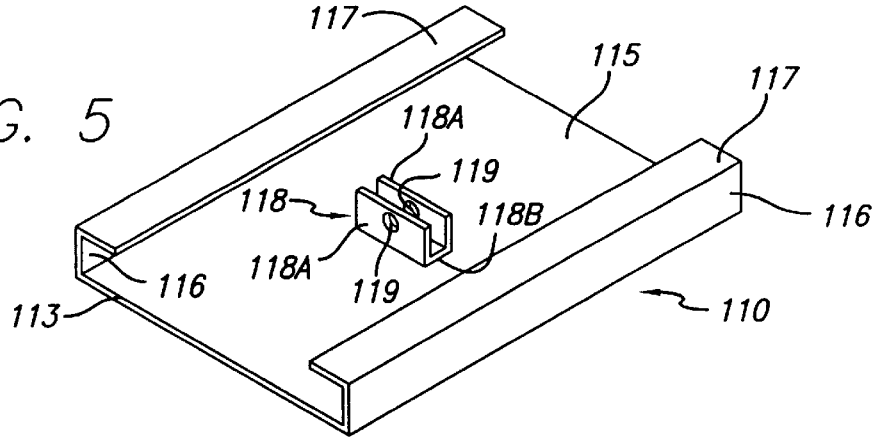
FIG. 5
FIG. 6
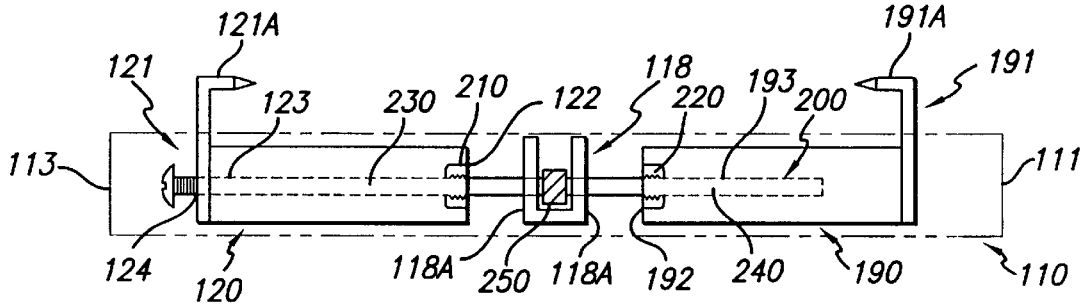

180
50
181

SECURITY HARDWARE DEVICE FOR CLAMPING MULTI-LEAFED MATERIALS

The present invention relates to a device for securing multi-leafed materials, such as telephone books, so that the materials may be used by the public and so that unauthorized removal of the materials is prevented.

BACKGROUND

Because it is desirable to have some multi-leafed materials such as telephone books, catalogs and magazines available for public use, various devices have been considered to prevent unauthorized removal of these materials. Among these devices are binders which secure a book by means of support rods or wires interleaved among the pages of the book. The support rods are then fixed to mounts at either end of the book. For instance, Nawman (U.S. Pat. No. 3,860,212) described a telephone book holder with metal rods which are interleaved among the pages of the book or pass through the backing of the book. The ends of the metal rods are received by holes in perpendicular flanges which project from either end of the spine. The ends of the support rods may be bent or expanded to secure them to the flanges and thus prevent removal of the book from the binder. Shepherd et al. (U.S. Pat. No. 4,561,623) described a book holder with book retaining wires pivotally connected at the top end of the spine which can be press fitted to the other end of the spine to retain a telephone book in position. Top and bottom caps are securable to the ends of the spine to retain the covers and the wires on the spine.

Although security binders which incorporate rods or wires interleaved among the pages of a book to secure the book within a binder are useful in preventing unauthorized removal of materials, this type of security binder also presents some difficulties. In some instances, especially where the rod or wire is made thicker or wider to give the rod more strength, those words which are printed nearest the spine of the book can be obscured by the rod. In addition, typically several steps are required to interleave rods and install a telephone book within such a device. This is especially apparent in devices made according to the Shepherd et al. disclosure in which separate top and bottom caps are needed to retain the covers and wires on the spine.

Although some of the devices discussed above present viable means for securing multi-leafed materials within a binder or to a spine, it is desirable to have a device of single piece construction which can be readily fitted to the spine of multi-leafed materials, such as telephone books. It is also desirable to have a device which grips the ends of the multi-leafed material so that no portion of the printed text of the book is obscured by a rod which has been interleaved between the pages of the book.

SUMMARY OF THE INVENTION

It is an object of this invention to overcome the problems of the prior art and provide a device of one-piece construction which can be readily fitted to the spine of multi-leafed materials. It is another object of this invention to provide a device which grips the ends of the multi-leafed materials so that no part of the printed text of the material is obscured by an interleaving rod.

BRIEF DESCRIPTION OF THE DRAWINGS

FIG. 1 is a perspective view of the security hardware device.

FIG. 2 is a bottom view of the security hardware device.

FIG. 3 is a top view of the security hardware device.

FIG. 4 is a side view showing the security hardware device being mounted on a telephone book.

FIG. 5 is a perspective view of the exterior sleeve in an alternate embodiment of the present invention.

FIG. 6 is a partial sectional view of an alternate embodiment of the present invention.

DETAILED DESCRIPTION OF THE PREFERRED EMBODIMENTS

Figure 7:
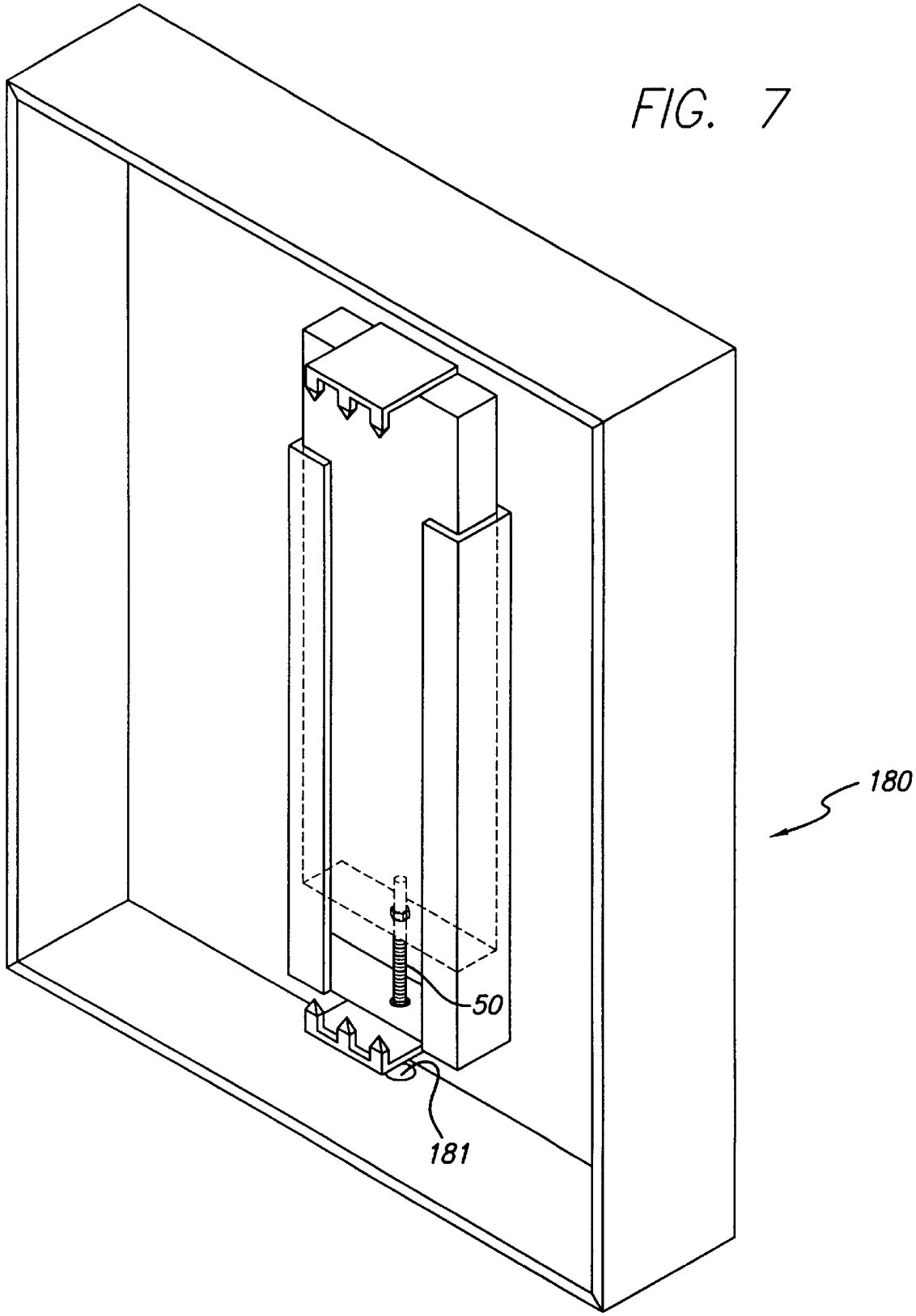
FIG. 7 shows an exterior receptacle in which the security hardware device may optionally be mounted.

As shown in FIG. 1, the security hardware device 1 of the present invention includes outer sleeve 10, inner sheet metal box 20, top grip 30, bottom grip 40 and screw 50. Top grip 30 and bottom grip 40 are adapted for engagement with the spine of a telephone book.

As shown in FIG. 1, security hardware device 1 includes inner sheet metal box 20 and outer sleeve 10. Inner sheet metal box 20 is rectangular in shape and sized so that sheet metal box 20 may slide within sleeve 10. Top grip 30 is mounted on one end of sheet metal box 20 with the opposite end of box 20 provided with a passage 21 for receiving screw 50. At one end, passage 21 is provided with opening 22 for receiving weld nut 23, which is threaded for engagement with screw 50.

Top grip 30 includes flat body portion 31 and teeth 32. As shown in FIGS. 1 and 3, top grip 30 is mounted onto box 20 so that body portion 31 of grip 30 is perpendicular to box 20. Body portion 31 is welded or otherwise permanently adhered to box 20. Teeth 32 are positioned perpendicular to body portion 31 and parallel to box 20.

A shown best in FIG. 1, sleeve 10 is also rectangular in shape having a back wall 15, two side walls 16, and two front rails 17 and partially surrounds box 20. Sleeve 10 further includes one open end 13 and one closed end 11. As shown in FIGS. 1 and 2, bottom grip 40 is mounted to closed end 11 of sleeve 10. Screw hole 12 passes through closed end 11 and bottom grip 40. Similarly to top grip 30, bottom grip 40 includes flat body portion 41 and teeth 42. Bottom grip 40 is mounted onto closed end 11 of sleeve 10 so that body portion 41 of grip 40 is perpendicular to sleeve 10. Body portion 41 is welded or otherwise permanently adhered to closed end 11 of sleeve 10. Teeth 42 are positioned perpendicular to body portion 41 so that teeth 42 of bottom grip 40 will oppose teeth 32 of top grip 30.

Sheet metal box 20 is positioned within sleeve 10 so that the end of box 20 with top grip 30 mounted thereon protrudes beyond open end 13 of sleeve 10. When positioned within sleeve 10, box 20 rests against back wall 15. Box 20 is held in place by side walls 16 and front rails 17. As previously stated, box 20 is sized so that it can slide up and down in sleeve 10.

In use, screw 50 is inserted through screw hole 12 in bottom grip 40 and closed end 11 of sleeve 10. Screw 50 is then turned into engagement with the threads of passage 21 of box 20. As shown in FIG. 4, the spine of a telephone book 60 is positioned on security hardware device 1 between top grip 30 and bottom grip 40. As screw 50 is turned into engagement with the threads of passage 21, box 20 is drawn toward closed end 11 of sleeve 10, forcing teeth 42 and 32 into the pages of book 60 adjacent to the spine of the book. Screw 50 should be tightened until teeth 42 and 32 are firmly and securely embedded in the pages of book 60 and body portions 41 and 31 are pressed firmly against either end of the book.

The telephone book and security hardware assembly can be attached to a telephone booth, desk, or other surface by means of a cord or chain 70, one end of which is secured to sleeve 10 with the opposite end being secured to a surface.

An alternate embodiment of the security hardware device of the present invention is shown in FIGS. 5 and 6. As shown in FIG. 5, sleeve 110 is rectangular in shape having a back wall 115, two side walls 116, and two front rails 117. Sleeve 110 further includes open ends 113 and 111. Bracket 118 is attached to back wall 115 of sleeve 110. Bracket 118 includes two upright members 118A with bottom member 118B extending between the upright members for attachment to back wall 115 of sleeve 110. Each of upright members 118A is provided with an opening 119 for receiving threaded rod 200. Threaded rod 200 has a first section 230 with left handed threads and a second section 240 with right handed threads.

As shown best in FIG. 6, sheet metal boxes 120 and 190 are positioned within sleeve 110. Both boxes 120 and 190 are rectangular in shape and sized so that they can slide within sleeve 110. Grip 121 is mounted onto the end of box 120 adjacent to open end 113 of sleeve 110. Grip 121 is provided with teeth 121A. Grip 121 is further provided with hole 124 for receiving rod 200. The end of box 120 opposite grip 121 is provided with opening 122 for receiving left hand threaded weld nut 210. Smooth bore passage 123 extends from opening 124, through the length of box 120, and terminates with opening 122. Grip 191 is mounted onto the end of sheet metal box 190 adjacent to open end 111 of sleeve 110. Grip 191 is provided with teeth 191A which oppose teeth 121A of grip 121. The end of box 190 opposite grip 191 is provided with opening 192 for receiving right hand threaded weld nut 220. Smooth bore passage 193 extends from opening 192 and into box 190.

As shown best in FIG. 6, to assemble the device, rod 200 is inserted through opening 124 in grip 121 and into bore 123 of box 120. The left handed threads of the first section 230 of rod 200 are engaged with left handed thread weld nut 210. Rod 200 is then passed through each of openings 119 in bracket 118. The right handed threads of the second section 240 are then engaged with right handed thread weld nut 220. Stop 250 is mounted on rod 200 between upright members 118A. Stop 250 holds rod 200 in place.

In use, the spine of a telephone book is positioned on the security hardware device between teeth 121A and teeth 191A. Rod 200 is then turned in first direction causing the left handed threads of the first section 230 to engage with the left handed thread weld nut 210 in box 120 and the right handed threads of the second section 240 to engage with the right handed threads of weld nut 220 in box 190 thereby causing boxes 120 and 190 to be drawn toward bracket 118. Rod 200 should be turned in the first direction until teeth 121A and 191A on boxes 120 and 190 are firmly and securely embedded in the pages of the telephone book. To release a telephone book from the security hardware device, rod 200 is turned in the opposite direction causing the threads of first section 230 and second section 240 to disengage with weld nut 210 and weld nut 220.

As with the first embodiment of the invention, the alternate embodiment of the security hardware device can be attached to a surface by means of a cord or chain, one end of which is attached to sleeve 110 with the opposite end being secured to a surface.

The security hardware device of the present invention may optionally be mounted within exterior receptacle 180 shown in FIG. 7. To mount the security hardware device of the present invention within exterior receptacle 180, the outer sleeve of the device is secured to the floor 182 of the receptacle. When the device is mounted within receptacle 180, opening 181 should be formed in the receptacle to permit access to screw 50 or rod 200.

What is claimed is:

1. A security hardware device for securing multi-leafed materials, said device including:

a. an inner box positioned within an outer sleeve;

b. said inner box having a first end provided with a toothed grip and a second end provided with a means for receiving a screw;

c. said outer sleeve having a first open end for receiving said inner box and second closed end, said closed end provided with a toothed grip;

d. said closed end of said outer sleeve being further provided with a hole for passing a screw through said outer sleeve and into said means for receiving a screw so that as the screw is turned into engagement, said inner box is drawn into said outer sleeve; and e. means for attaching said outer sleeve to a surface.

2. The device of claim 1 wherein said outer sleeve completely surrounds said inner box.

3. The device of claim 1 wherein said outer sleeve is secured within an exterior receptacle, said exterior receptacle being provided with means for attachment to a surface.

4. A security hardware device for securing multi-leafed materials, said device including:

a. a first inner box and a second inner box positioned within an outer sleeve, each of said inner boxes provided with a toothed grip;

b. a threaded rod having a first section and a second section, the threads of said second section being opposite the threads of said first section;

c. said first inner box having means for engaging the threads of said first section of said threaded rod and said second inner box having means for engaging said second section;

d. means for turning said threaded rod into engagement with said means for engaging said first section and said means for engaging said second section so that said first inner box and said second inner box are drawn closer together; and e. means for attaching said outer sleeve to a surface.

5. The device of claim 4 wherein said outer sleeve completely surrounds said inner box.

6. The device of claim 4 wherein said outer sleeve is secured within an exterior receptacle, said exterior receptacle being provided with means for attachment to a surface.

* * * * *